US005246103A

United States Patent [19]

Hicks

[11] Patent Number: 5,246,103

[45] Date of Patent: Sep. 21, 1993

[54] JEWELRY CONTAINER

[76] Inventor: Valerie S. Hicks, Box 928, Girdwood, Ak. 99587

[21] Appl. No.: 885,541

[22] Filed: May 19, 1992

[51] Int. Cl.[5] ..... B65D 73/00

[52] U.S. Cl. ..... 206/6.1; 206/495; 206/806; 383/81; 383/84; 383/29; 383/40

[58] Field of Search ..... 206/6.1, 495, 581, 535, 206/289, 292, 298, 477, 483, 806, 823; 383/38, 39, 40, 24, 29, 84, 81, 78

[56] References Cited

U.S. PATENT DOCUMENTS

| | | | |
|---|---|---|---|
| 2,080,453 | 5/1937 | Kraut | 383/81 X |
| 2,784,956 | 3/1957 | Resnick | 383/81 X |
| 4,324,446 | 4/1982 | LeSage | 312/245 |
| 4,388,959 | 6/1983 | Handy et al. | 150/52 R |
| 4,401,219 | 8/1983 | Mink | 206/566 |
| 4,821,883 | 4/1989 | Miller | 206/495 |
| 4,848,585 | 7/1989 | Snyder | 206/566 |
| 4,953,765 | 9/1990 | Little et al. | 383/39 X |
| 4,960,204 | 10/1990 | Young et al. | 383/39 |
| 4,978,001 | 12/1990 | Nelson | 206/45.11 |
| 5,025,918 | 6/1991 | Bergeron | 206/45.14 |
| 5,035,319 | 7/1991 | Kunisch | 206/6.1 |
| 5,050,745 | 9/1991 | Sanders | 206/495 X |
| 5,117,971 | 6/1992 | Fisher | 206/6.1 |

*Primary Examiner*—Steven N. Meyers
*Assistant Examiner*—Jacob K. Ackun, Jr.
*Attorney, Agent, or Firm*—Frederick E. Mueller

[57] ABSTRACT

A shallow rectangular frame has a hanger by which it can be suspended. The frame internally mounts a compartment-defining sheet with vertically oriented partitions. Upper ends of each of the compartments have hooks from which to suspend elongate articles of jewelry within the compartments. An auxiliary cloth panel of rectangular configuration has a plurality of pockets and is tackable or pinable to receive various articles of jewelry. In the underside of the top rail a plurality of horizontally spaced apart outwardly facing cup hooks are provided to engage a rod carried in aligned fabric loops at the upper edge of the auxiliary panel. The panel can thus be selectively placed laterally with respect to the main frame to expose the open sides of some only of the compartments. A travel envelope can be sleeved over the auxiliary panel and has a plurality of external pockets to receive sundry items. Velcro patches are provided along the travel envelope sleeve opening and on opposite sides of the upper edge of the auxiliary panel. A flap with pairs of Velcro patches along opposite edges is selectively detachably connectable to either the upper edge of the travel envelope or the upper edge of the auxiliary panel.

13 Claims, 4 Drawing Sheets

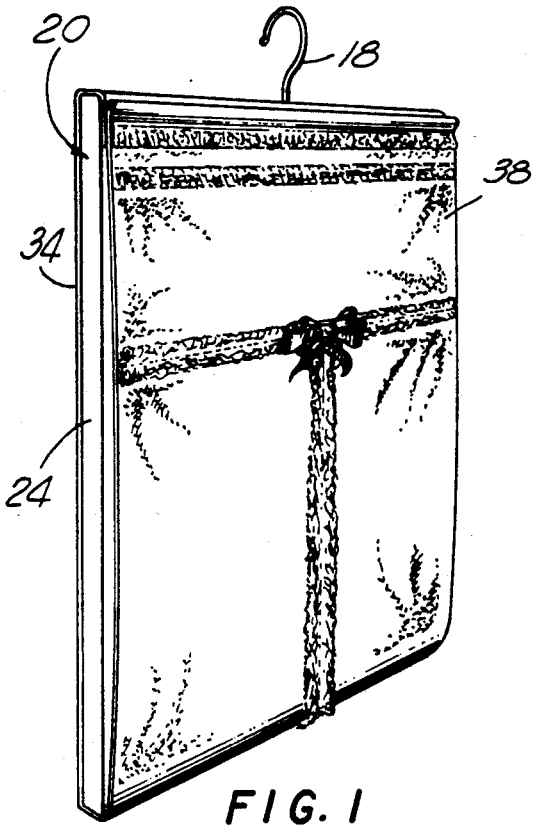
FIG. 1
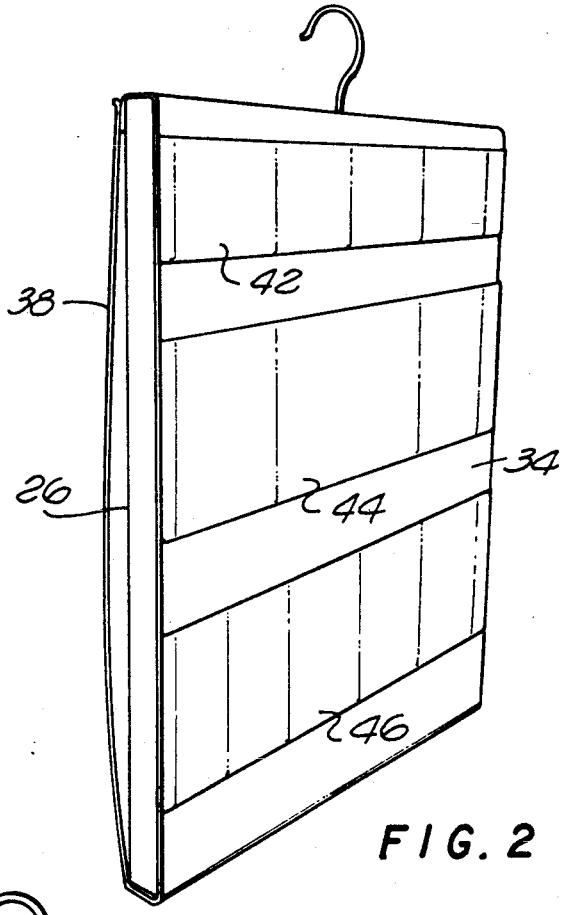
FIG. 2
FIG. 3
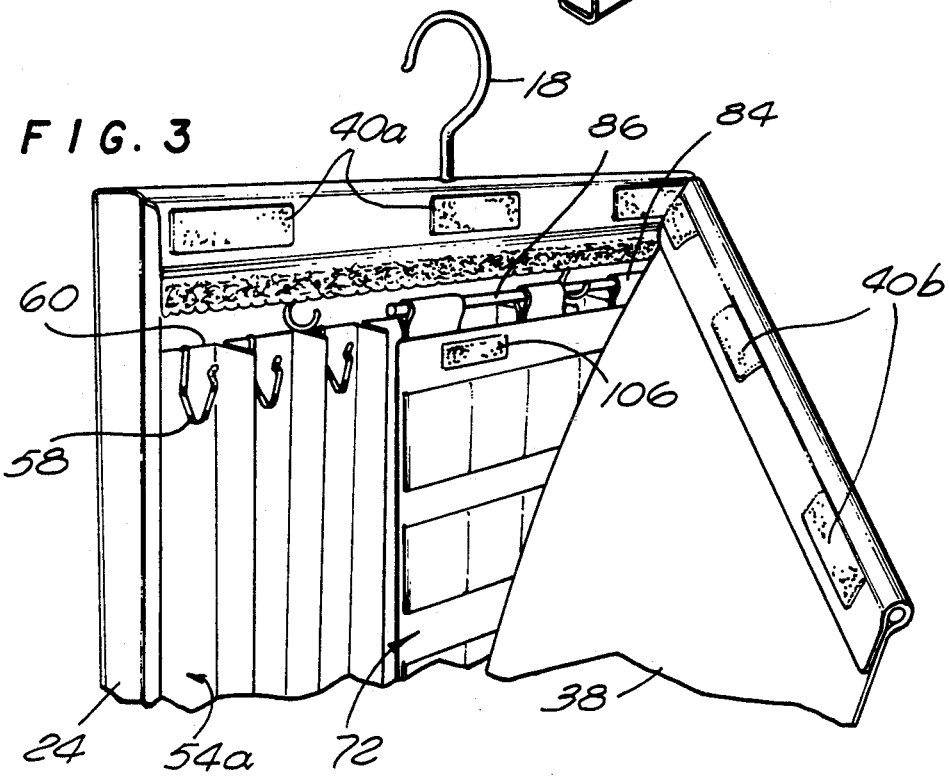

JEWELRY CONTAINER

BACKGROUND OF THE INVENTION

The present invention relates to containers for the storage of articles of jewelry and, more particularly, to a container in which a wide variety of pieces of jewelry can be stored and displayed in an organized fashion and readily retrieved therefrom.

A wide variety of containers adapted for housing many items of jewelry have heretofore been devised and marketed. Some merely comprise a lidded box, sometimes compartmented, which occupy relatively large areas of dresser surface and in which the items of jewelry often become entangled with one another as the capacity of the box is neared. Another class of jewelry containers comprises articles made out of foldable sheet materials, such as fabric, provided with compartments or other means for holding items of jewelry. Exemplary of this approach to the problem are Bergeron Pat. No. 5,025,918; Mink patent No. 4,401,219; Miller patent No. 4,821,883 and Handy et al Pat. No. 4,388,959. Some of these, such as that shown in Mink Pat. No. 4,401,219, can be hung from a hanger hook or the like while others, such as that of Handy et al, can be folded upon themselves and/or folded and carried in the manner of a handbag, as in Bergeron. Another class of jewelry containers comprises rigid or hard-case containers, usually comprising compartmented and hingedly interconnected structures. Examples of this class are disclosed in LeSage Pat. No. 4,324,446; Snyder U.S. Pat. No. 5,035,319.

A primary object of the present invention is to provide an improved jewelry container in which a large number of a variety of items of jewelry, such as chains, necklaces, brooches and earrings, can be protectively stored, displayed and organized in individualized compartments without becoming entangled or intermingled and, further, in which all or some of certain ones of the compartments, as desired, can easily be exposed to view to facilitate the insertion or retrieval of jewelry. In addition, it is also an object of the invention to provide a dual-purpose separable component which, when detached from the main component of the container, can be utilized as a travel bag for transporting a desired selection of jewelry items. These, and other objects and advantages of the invention will appear.

SUMMARY OF THE INVENTION

In a presently preferred embodiment of the invention, the jewelry container has a rigid rectangular frame to define a shallow compartment. A backside of the frame is permanently covered by about one-half of a length of a cover sheet of fabric or the like. The remaining portion of the sheet is large enough to provide a front cover flap which is turned up from the bottom rail of the frame to have its upper edge removably secured, e.g., as by means of spaced Velcro fasteners of the hook and eye type, to the front face of the top rail of the frame. An upstanding swivel hook is secured to the top face of the top rail by means of which the container can be hung either on a clothespole in a closet or against a wall on a wall hook.

Overlaying the back panel of the cover fabric, inside the rigid frame, is another sheet of a flexible material, such as taffeta or satin with a fabric underlayer, of sufficient stiffness to be formed into a series of vertically arranged permanent or shape-holding pleats to define a plurality of a essentially flat-U-shaped individual compartments for the reception of elongated articles such as necklaces. The upper end of each of these compartments is fitted with a centrally positioned drapery hook or the like secured to the top edge of the sheet. At the lower end of each compartment a detachable fastener means is fitted for connection to the lower end of an elongated article suspended from the hook. This latter means could take the form of, e.g., a rubber band mounted hook or a loop of Velcro by means of which a necklace, e.g., is restrained against flapping around within the compartment.

A gap is defined between the upper edge of the compartment-defining sheet and the lower face of the frame top rail to give access to a spaced apart series of outwardly facing cup hooks mounted in the bottom face of the top rail. These hooks removably receive a rod carried horizontally in a spaced apart and aligned series of fabric loops secured to the upper edge of an auxiliary panel. The auxiliary panel is a rectangular flexible sheet or sheets of stiffened taffeta, or the like, overlain on one or both sides by fabric pieces which, on the front side, are stitched to form horizontally disposed tiers of individual pockets adopted to receive small items such as earrings. The auxiliary panel is of substantially the same height but of lesser width than the compartment sheet. The auxiliary panel is selectively detachably supportable on the cup hooks to leave exposed less than all of the compartments defined within the frame. The auxiliary panel provides a tackable or pinable surface so that studs of jewelry and the like can be mounted thereon.

The auxiliary panel also serves as part of a travel case for transporting a variety of selected items of jewelry. To that end, the auxiliary panel is removably fitted with a tubular envelope of fabric material that can be sleeved over the auxiliary panel in the manner of a pillow case. This sleeve acts as a travel envelope to protectively enclose the items of jewelry contained in or stored on the auxiliary panel. Vertically spaced pockets are provided on one side of the envelope. The open end of the travel envelope has a removable flap foldable upon itself and fitted along both marginal edges with spaced Velcro hooks or eyes for registration with Velcro eyes or hooks on the front and rear faces of the open end of the travel envelope. Alternatively, the flap can be removed from the envelope and connected to Velcro strips along opposite sides of the upper end of the auxiliary panel. By this means a conventional wire hanger or the like can be received in the sleeve so formed whereby the travel envelope and/or auxiliary panel can be independently hung in a hotel room.

The outside surface of the back cover of the frame is also formed with a plurality of horizontal tiers of larger compartments to receive sundry items such as cosmetics, perfumes, or a hairpick.

BRIEF DESCRIPTION OF THE DRAWINGS

FIG. 1 is a front perspective view of a jewelry container embodying my invention, when closed.

FIG. 2 is a rear perspective view of the closed container of FIG. 1.

FIG. 3 is a partial front perspective view of the upper end portion of the container in FIG. 1, on a larger scale, but with the front panel of the cover partially detached from the frame of the container to disclose interior features.

DESCRIPTION OF THE PREFERRED EMBODIMENT

Figure 4:
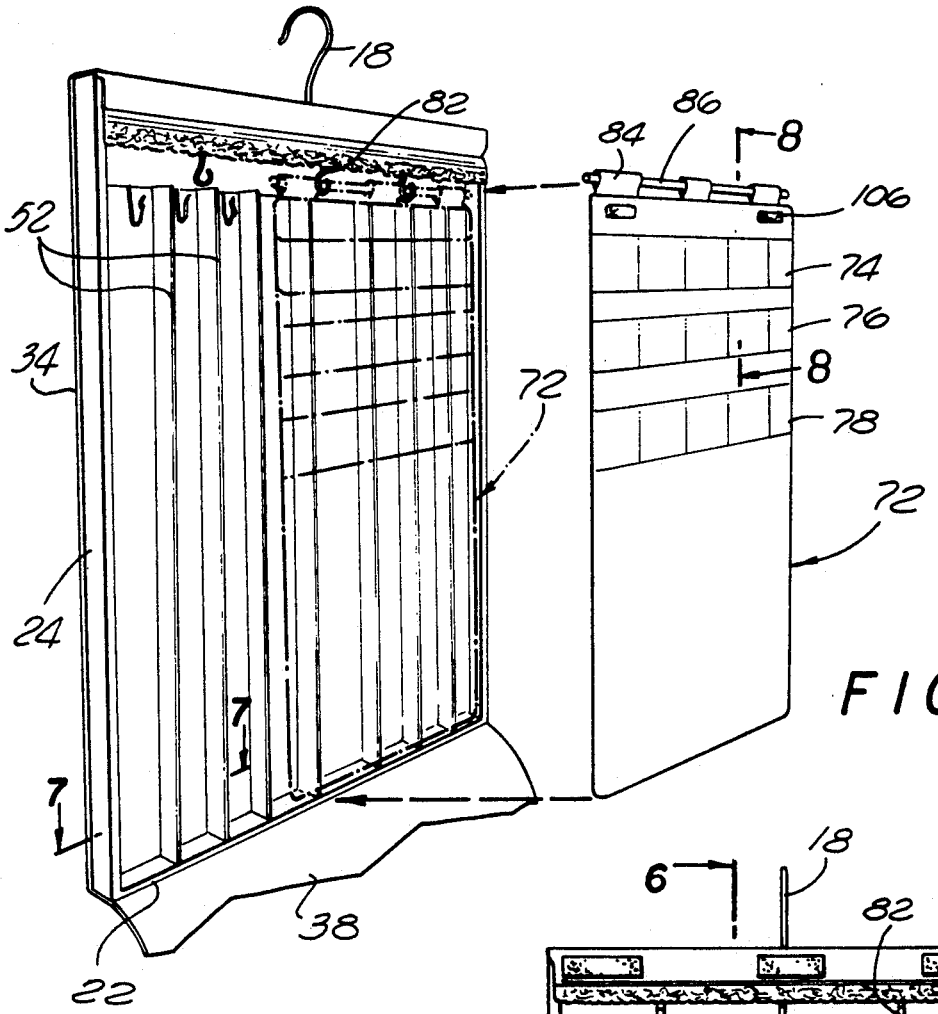
FIG. 4 is an exploded front perspective view of the container in an open condition with the front cover panel partly shown depending from the frame and with the auxiliary panel in a spaced registered relation relative to the base container.

Before explaining the invention in detail, it is to be understood that the invention is not limited in its application to the precise details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarding as limiting.

Referring to FIGS. 1 and 2, the presently preferred embodiment of the invention takes the form of a shallow or relatively thin soft-sided container having a rigid frame 20. By way of example, it may be about eighteen inches wide, twenty-three inches high and have a depth of about one and a half inches. The rectangular rigid framework comprises a bottom rail 22, opposite side vertically extending rails 24 and 26, and a top rail 28 of substantially greater cross sectional area than the other three rails. The top rail has a central upstanding swivel hook 18.

Figure 6:
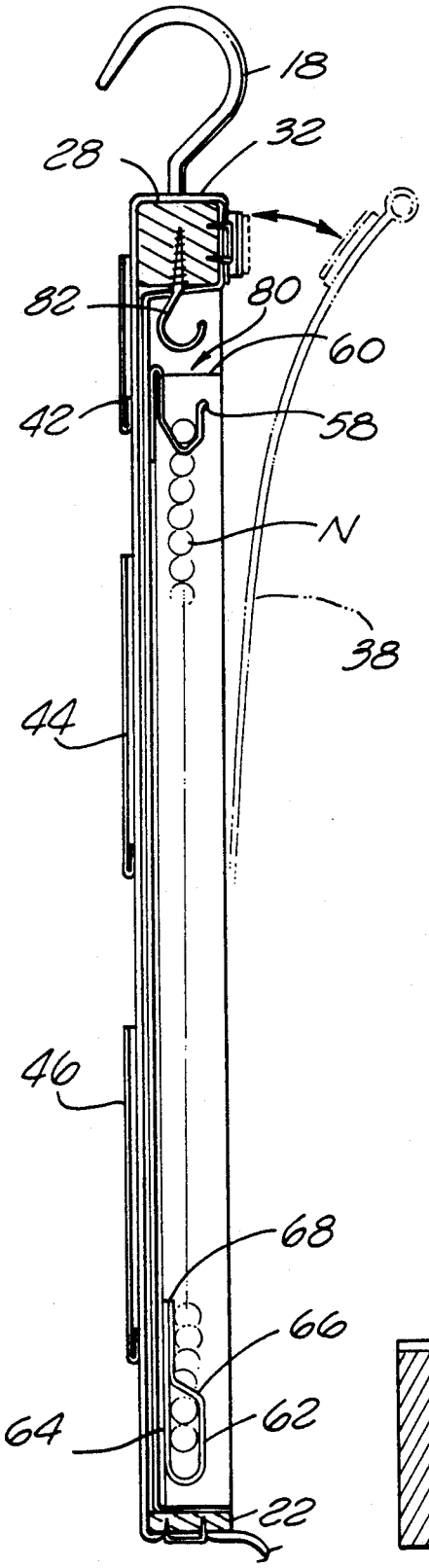
FIG. 6 is a vertical sectional view taken on the line 6—6 of FIG. 5.
Figure 8:
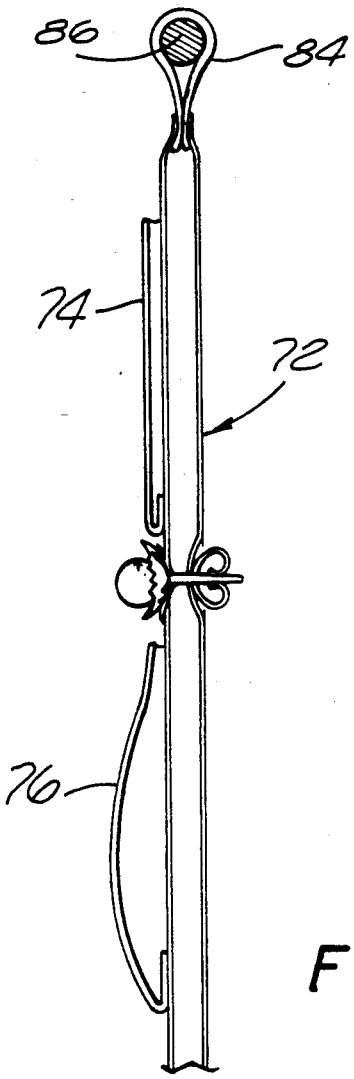
FIG. 8 is a vertical sectional view taken on the line 8—8 of FIG. 4, on a larger scale.

For ease in manufacture, the rigid frame may be enclosed in a single sheet of flexible material such as, e.g., a piece of satin or taffeta with a fabric underlining to give it body and some stiffness. One marginal end portion 32 of the sheet is tacked, stapled or otherwise secured to at least the front, top and rear faces of the top rail 28, as indicated in FIG. 6. The back side of the rigid frame is closed by a back panel portion 34 of the fabric that is preferably continuously secured to the rear faces of the side rails 24 and 26, e.g., as by a continuous line of adhesive, to prevent any gap between the sheet of fabric and the frame. The back panel is taut and is then reversely turned around the bottom rail 22, to which it is also secured, as by means of a spaced series of staples.

The remaining one-half or so of the sheet of fabric comprises a front panel 38 for the container. The upper marginal free end portion of the front panel 38 and the other end portion of the sheet secured over the front face of the top rail 28 of the frame are provided with cooperating means for releasably securing them together. Obviously, these securement means could take the form of a spaced series of buttons and snaps, or other means. However, in the illustrated example, the closure means takes the form of a spaced series of cooperating hook and loop structures such as that marketed under the trademark Velcro. Thus, a spaced series of Velcro hook or loop patches 40*a* are fastened along the top rail 22 to register with a series of cooperating hook or loop patches 40*b* secured to the inside of the cover panel 38. As will be evident, and as is shown in FIG. 3, cover panel 38 can thus be opened and closed relative to the container frame.

As shown in FIG. 2, the outer face of the back panel 34 of the container may be provided with three vertically spaced apart horizontal tiers of fabric pockets 42, 44 and 46. In order to accommodate a variety of sizes of sundry items, which may or may not be jewelry, these pockets are preferably formed in a variety of sizes. Thus, the upper tier 42 may comprise a plurality of relatively shallow pockets, the middle tier 44 may comprise a plurality of relatively deep and wide pockets, and the lower tier 46 may comprise a variety of relatively narrow but relatively deep pockets All of the pockets may be of conventional configuration having upper end openings which may or may not be provided with flaps.

Figure 5:
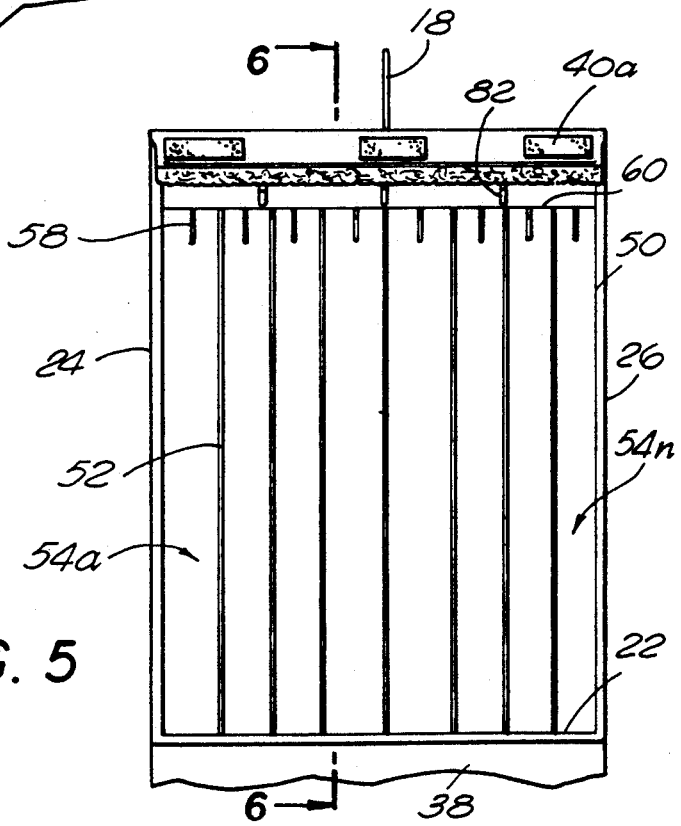
FIG. 5 is a front elevational view of the main compartment of the container.

Disposed within the frame 20 against the inner surface of the back panel 34 is a compartment defining sheet 50. The compartment defining sheet could take the form of a molded flock coated, synthetic plastic material which might also be formed integrally with the frame and/or back panel. In the presently preferred embodiment of the invention, a rectangular sheet of a relatively stiff material, such as satin with an underliner, is folded into a spaced apart series of parallel pleats, which are appropriately stitched to hold their stiffened shape. As is indicated in FIG. 5, the pleats 52 are oriented vertically within the frame 20 and may be spaced apart horizontally variable distances to define a plurality of vertically oriented compartments 54*a–n*.

Figure 7:
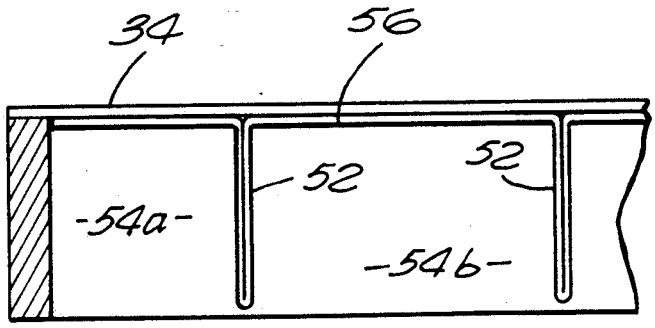
FIG. 7 is a partial sectional view, taken on the line 7—7 of FIG. 4, on a larger scale.
Figure 9:
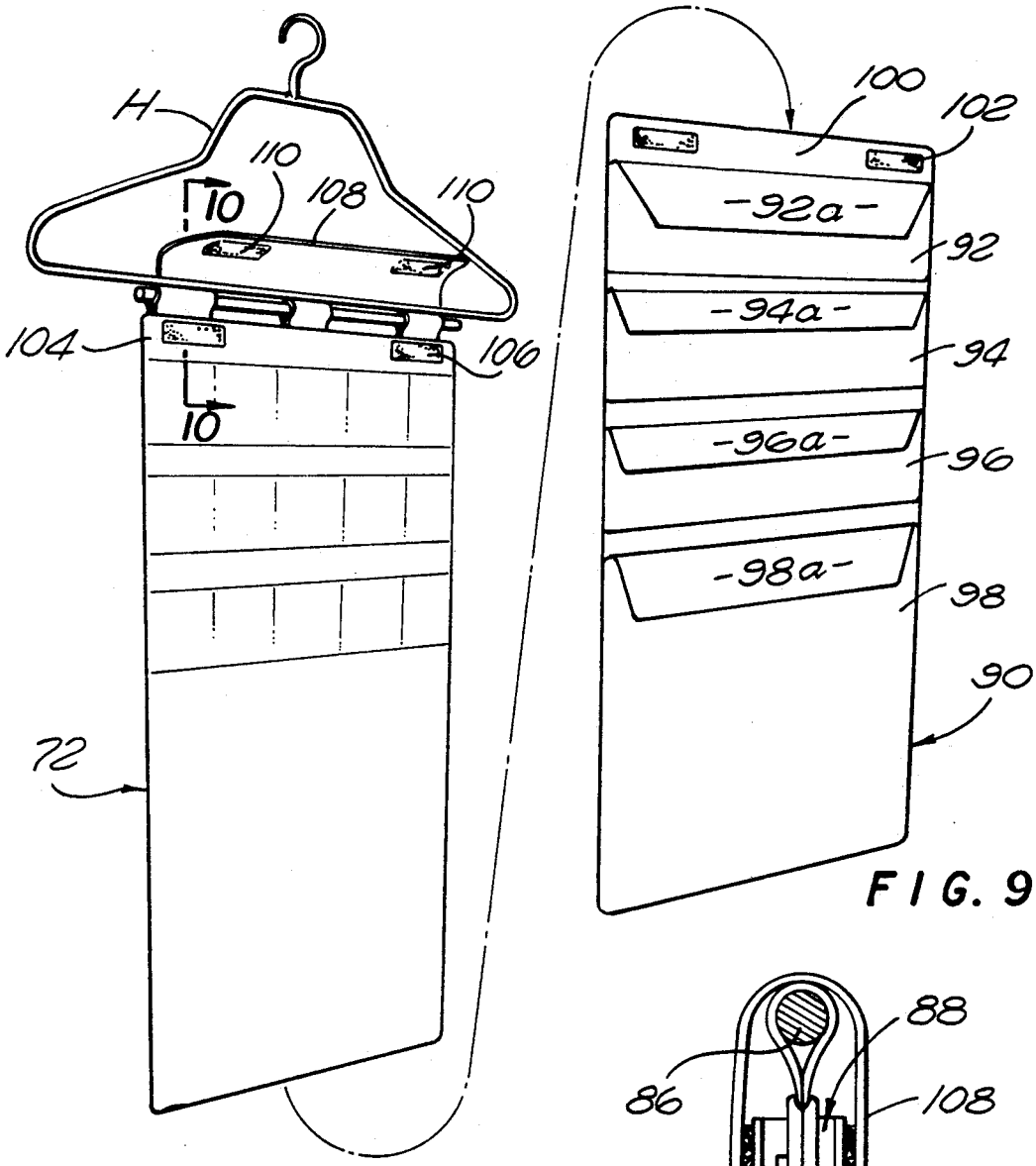
FIG. 9 is an exploded front perspective view of the auxiliary panel and travel envelope components of the invention.
Figure 10:
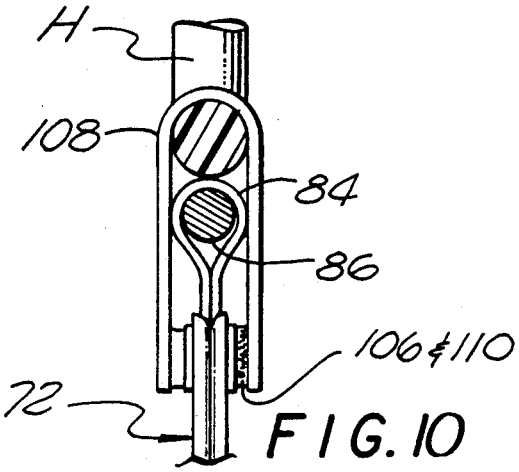
FIG. 10 is a vertical sectional view taken on the line 10—10 of FIG. 9, on a larger scale, but showing the detachable flap in a closed condition to support the auxiliary panel from a conventional wire hanger.

As is shown in FIG. 7, each of these compartments is preferably of a flat U-shaped cross-sectional configuration. The backsides of the floor or base portions 56 of the compartments 54*a–n* are preferably permanently secured to the inside surface of the back panel 34 of the container by any appropriate means, such as continuous stitching or continuous lines of adhesive. The upper end of each compartment 54*a–n* is centrally fitted with a drapery hook 58, or the like, having an inner end 58 hooked over an upper edge 60 of the compartment defining sheet 50. A long article, such as a necklace N, can then be suspended from the hook within one of the compartment. In order to restrain the necklace against undesired movement or rattling, a releasable fastener is mounted within the compartment at an appropriate distance more or less remote from the drapery hook 58. As shown in FIG. 6, this may, for example, take the form of a length 62 of ribbon or fabric, having an inner end 64 secured to the compartment floor 56 whereby a free end 66 of the piece ca be looped around a lower end portion of the necklace. A Velcro patch fastener means 68, or the like, is provided on the ends of the piece of fabric which can be opened and closed as desired to release or to hold the lower end of the necklace.

If desired, some of the compartments 54*a*–n may be adapted to support articles of jewelry other than necklaces. For example, one of the compartments may be fitted with a vertically spaced apart series of drapery hooks set into the floor 56 of the compartment to serve as bracelet hooks. Another of the compartments could be fitted with a parallel pair of side-by-side cushioned velvet rolls to define a vertically extending, close-fitting slit into which a plurality of rings can be snugly inserted.

The container includes an auxiliary panel 72 adapted to be suspended within the frame 20 to overlie some of the compartments 54*a–n*. Preferably, the panel 72 comprises a rectangular flexible sheet of a cloth, e.g., two plies of stiffened taffeta, or a plastic material which can be penetrated by pins or the studs of pieces of jewelry and overlain o both sides with appropriate pieces of decorative fabric. On one side, the auxiliary panel may be fitted with three horizontally extending tiers of small cloth pockets 74, 76 and 78. Each of the pockets is upwardly opening and sized to accommodate items such as rings or earrings. While a variety of arrangements can be made, I prefer the tiers of ring pockets to be formed in the upper portion of the auxiliary panel 72, leaving the lower portion available as a tackable or pinable surface to which brooches or the like can be secured.

The auxiliary panel 72 is of about the same vertical dimension as the compartment defining sheet 50 but preferably of a lesser width, e.g., about one half the width of the compartment sheet, whereby to cover less than all of the compartments 54*a–n*. In order to detachably support the panel within the rigid frame 20, a gap 80 is defined between the upper edge 60 of the compartment defining sheet 50 and the lower face of the fabric covered top rail 28. Clearance is thus provided for a plurality of cup hooks 82, each of which is screwed into the underface of the top rail 28 and finally set in a position to open forwardly or outwardly. At its upper edge the auxiliary panel 72 is fitted with a horizontally spaced apart and co-axially aligned set of fabric loops 84 through which a length of dowel 86 is received. As will now be apparent, the dowel 86 can be supported centrally or on either the right hand or, alternatively, the left hand cup hooks 82 to leave exposed, respectively, either left hand or right hand ones of the compartments 54*a–n*. Also, as illustrated in FIG. 4, the auxiliary panel 72 is detachably mounted and movable between the solid and dotted outline position illustrated.

When detached from the frame 20, the auxiliary panel 72 may be encased in a travel envelope 90 for packing in a suitcase in the same manner as a garment. The travel envelope 90 comprises a tubular cloth sleeve, like a pillow case, having an opening 88 in its upper end by means of which the auxiliary panel 72 may be slipped into and withdrawn from the envelope. On one face the travel envelope 90 is provided with a vertically spaced apart series of cloth pockets 92, 94, 96 and 98, the upper open ends of which may be provided with closure flaps. Each of the closure flaps 92*a*, 94*a*, 96*a* and 98*a* may be provided, e.g., with a zipper, button or Velcro closure means. Preferably, each of these pockets is as wide as the travel envelope 90. The shallower pockets 92, 94 and 96 thus may be used to receive horizontally disposed necklaces, while the deeper pocket 98 is adapted to hold relatively large accessories.

The upper end of both of the opposite sides of the travel envelope 90 has a marginal area 100 fitted with a pair of Velcro patches 102 at opposite ends of the areas 100. In similar fashion, the upper end of the auxiliary panel 72, on both sides, has an upper end marginal area 104 that is provided with a pair of Velcro tabs or patches 106 at opposite ends of the area. A hanger panel 108, comprising a rectangular piece of fabric having two pairs of Velcro patches 110 along the opposite long marginal edges thereof, is releasably securable to either the four patches 106 of the auxiliary panel 72 or the four similar patches 102 of the travel envelope 90.

Figure 11:
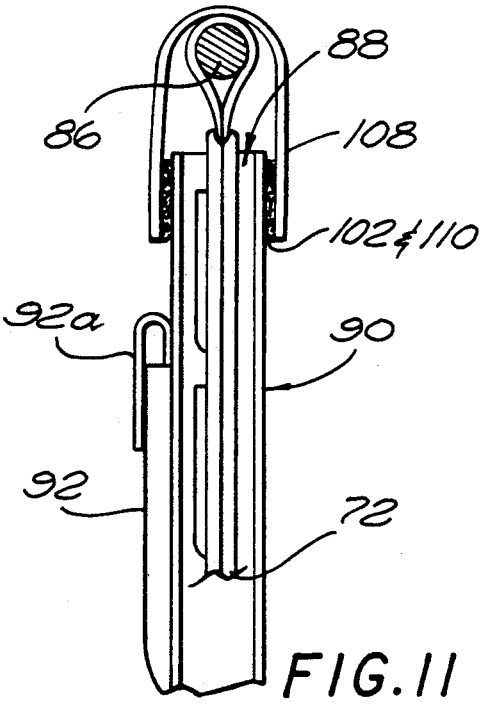
FIG. 11 is a view similar to FIG. 10 but without the conventional hanger of FIG. 9 and including the upper end portions of the travel envelope and auxiliary panel.

Referring to FIG. 11, the auxiliary panel 72 is depicted within the travel envelope 90 while the hanger panel 108 is secured by means of its Velcro patches 110 to the corresponding pairs of Velcro patches 102 of the auxiliary panel. This combination makes a secure travel package in which selected items of jewelry, having been removed from the compartment of main frame 20, can be packed in the manner of a garment (hung or folded or rolled) within a piece of luggage to be taken to a destination away from home. Then, the hanger panel 108 is removed from the travel envelope 90 so that the travel envelope can be sleeved off of the auxiliary panel 72. Thereafter, the hanger panel 108 can be wrapped around the rung of a conventional hanger H to bring its four Velcro patches 110 into contact with the Velcro patches 106 of the auxiliary panel, whereby the assembly can then be suspended from a hook by means of conventional hanger H.

In the foregoing it will be understood that the term "Velcro patches" is generic to either hooks or loops. As will be apparent, when a pair of Velcro patches are located to come into and out of registration with one another, one of the patches provides a field of hooks while the other provides a field of loops. By way of example, the four patches 110 of the detachable hanger panel 108 may all be hooks while the sets of patches 102 and 106 would all be eyes.

I claim:

1. A container for personal articles comprising:

a rigid rectangular frame;

a compartment-defining sheet mounted within said frame that extends between a pair of opposite sides of said frame, said sheet being formed with a plurality of partitions that are substantially parallel to said opposite sides of said frame to define a plurality of substantially separate individual compartments for the suspension of articles of jewelry therein;

a hanger means externally connected to one end of said frame to suspend said frame therefrom to vertically orient said compartments; and a means within each of said compartments from which to suspend an article when said frame is suspended from said hanger means.

2. A container according to claim 1 further comprising a substantially planar auxiliary panel, said panel being of substantially rectangular configuration that is receivable within said frame;

said one end of said frame and one edge of said panel having cooperating means for detachable interconnection therebetween whereby said panel can be removed from said frame or can be suspended within said frame in a position overlapping some at least of said compartments;

said panel having means for releasably supporting personal articles.

3. A container according to claim 2 in which said last mentioned means is a penetratable material of said panel.

4. A container according to claim in which said last mentioned means comprises pockets formed on at least one side of said panel.

5. A container according to claim 2 in which:

said auxiliary panel comprises a fabric material having a length approximately the same as that of said compartments and having a horizontal width substantially less than that of said compartment-defining sheet;

said cooperating means for detachable interconnection comprising a portion on said one end of said frame that extends substantially the length of said one end of said frame whereby said panel can be suspended or detachably interconnected within said frame to leave exposed some of said compartments.

6. A container according to claim 2 in which:

said auxiliary panel comprises a fabric material having a width less than that of said compartment-defining sheet, said panel having a plurality of pockets on one side thereof;

and further comprising a substantially rectangular travel envelope having an open end through which said auxiliary panel can be inserted into and withdrawn from said travel envelope to be substantially fully enclosed thereby whereby after said panel is detached from said frame and inserted into said envelope, said panel and envelope can be packed in luggage in the same manner as a garment;

said envelope at said one end having a flap for closing said envelope.

7. A container according to claim 6 further comprising a plurality of pockets on one side of said envelope.

8. A container for personal articles comprising:

a rigid rectangular frame comprising a top rail, a bottom rail and a pair of opposite side rails;

a planar sheet of material closing a back side of said frame;

a compartment-defining sheet mounted within said frame to extend between said pair of opposite side rails, said sheet being formed with a plurality of partitions that are substantially parallel to said opposite side rails to define a plurality of individual compartments for the suspension of articles of jewelry therein;

a hanger means externally mounted on said top rail to suspend said frame therefrom to vertically orient said compartments;

a means within each of said compartments from which to suspend an article when said frame is suspended from said hanger means;

a front panel connected to one of the opposite ends of said frame for opening and closing movement relative to a front side of said frame;

a free end of said front panel and a rail of said frame having cooperating means for detachable interconnection; and a means within each of said compartments from which to suspend an article when said frame is suspended from said hanger means.

9. A container according to claim 8 further comprising:

a substantially planar auxiliary panel, said panel being of substantially rectangular configuration of less than the width of said compartment defining sheet and of a length approximating that of said compartments;

said top rail of said frame and an upper edge of said panel having cooperating means for detachable interconnection therebetween whereby said panel can be suspended within said frame to overlap some of said compartments;

said panel having means for releasably supporting personal articles.

10. A container according to claim 8 in which:

said compartment-defining sheet comprises a pleated fabric having an upper edge spaced from an inside surface of said top rail of said frame defining a clearance gap for said upper edge of said auxiliary panel and said cooperating means for detachable interconnection of said frame and said panel, whereby said auxiliary panel can be suspended within said frame within the space subtended between said front and rear sides of said frame.

11. A container according to claim 9 further comprising:

a substantially rectangular travel envelope comprising a substantially rectangular sleeve having an open end by means of which said panel can be inserted into and withdrawn from said travel envelope;

said travel envelope having a closure flap at said open end whereby once said panel is detached from said frame and inserted into said envelope, said envelope can be closed;

said envelope being formed on a side thereof with a plurality of external pockets.

12. A travel container for personal articles comprising:

a substantially rectangular sheet of a pliant material having means for releasably supporting articles thereon;

a travel envelope comprising a substantially rectangular tubular sleeve having an open end through which said sheet can be inserted and withdrawn; and a closure flap at said open end of said travel envelope, said closure flap having along each of a pair of opposite edges thereof one half of a means for releasable interconnection with opposite sides of said open end of said envelope or, alternatively, with opposite sides of an edge portion of said panel, the other half of said means being disposed on opposite sides of upper edges of said sheet and said travel envelope.

13. A container as in claim 10 in which said travel envelope is provided on a side thereof with a plurality of pockets.

* * * * *

UNITED STATES PATENT AND TRADEMARK OFFICE

CERTIFICATE OF CORRECTION

PATENT NO. : 5,246,103

DATED : September 21, 1993

INVENTOR(S) : Valerie S. Hicks

It is certified that error appears in the above-identified patent and that said Letters Patent is hereby corrected as shown below:

In Column 6, line 65, "claim" should read --claim 2--.

Signed and Sealed this

Twenty-eighth Day of June, 1994

Bruce Lehman

*Attest:*

BRUCE LEHMAN

*Attesting Officer*

*Commissioner of Patents and Trademarks*